US007057883B2

(12) United States Patent
Besana

(10) Patent No.: US 7,057,883 B2
(45) Date of Patent: Jun. 6, 2006

(54) CONDUCTING ELEMENT FOR SHUNTING AN ELECTRIC POWER SUPPLY

(75) Inventor: Stefano Besana, Terno d'Isola (IT)

(73) Assignee: ABB Service S.r.l. (IT)

( * ) Notice: Subject to any disclaimer, the term of this patent is extended or adjusted under 35 U.S.C. 154(b) by 197 days.

(21) Appl. No.: 10/450,676

(22) PCT Filed: Dec. 6, 2001

(86) PCT No.: PCT/EP01/14469

§ 371 (c)(1),
(2), (4) Date: Jun. 17, 2003

(87) PCT Pub. No.: WO02/50855

PCT Pub. Date: Jun. 27, 2002

(65) Prior Publication Data

US 2004/0061993 A1 Apr. 1, 2004

(30) Foreign Application Priority Data

Dec. 18, 2000 (IT) ..... MI2000A2739

(51) Int. Cl.
*H01H 7/08* (2006.01)

(52) U.S. Cl. ..... 361/634; 361/673; 335/35; 335/172; 335/201

(58) Field of Classification Search ..... 361/601, 361/605, 621, 625, 626, 628, 631–637, 656, 361/663, 673, 644, 652, 825; 338/48, 49; 335/35, 201, 178, 14, 167–172; 439/715, 439/716

See application file for complete search history.

(56) References Cited

U.S. PATENT DOCUMENTS 3,344,394 A * 9/1967 Kinsgbury et al. ..... 439/814
3,694,701 A * 9/1972 Stanback ..... 361/634
3,755,733 A * 8/1973 Vankoughnett et al. ..... 324/640
3,956,723 A * 5/1976 Dickens et al. ..... 335/201
4,825,338 A * 4/1989 Hubbard et al. ..... 361/673
4,868,981 A * 9/1989 Hinckley et al. ..... 29/857
4,973,937 A * 11/1990 Weinstein et al. ..... 338/49
5,107,396 A * 4/1992 Rosen et al. ..... 361/637
5,432,491 A * 7/1995 Peter et al. ..... 335/35
6,129,595 A * 10/2000 Scanlon et al. ..... 439/716
6,441,708 B1 * 8/2002 Rodriguez et al. ..... 335/172

FOREIGN PATENT DOCUMENTS

EP 633588 A1 * 1/1995
FR 2264409 10/1975
FR 2577075 8/1988
FR 2742918 6/1997
JP 02183931 7/1990
JP 06131963 A * 5/1994

OTHER PUBLICATIONS

Search Report.

* cited by examiner

*Primary Examiner*—Michael Datskovskiy
(74) *Attorney, Agent, or Firm*—Connolly, Bove, Lodge & Hutz LLP

(57) ABSTRACT

A conducting element for shunting an electric power supply from a main conductor to an accessory device operatively associated with a circuit breaker, whose particularity consists of the fact that it comprises a contoured body that is meant to be arranged in a seat on the body of the circuit breaker in which a terminal for connection to the main conductor is arranged, the contoured body comprising at least one first surface that is suitable to be rested against a wall of the seat on the circuit breaker body and a second surface that protrudes at right angles from the first surface and is suitable to operatively couple to an additional conducting component that can be connected electrically to the accessory device.

20 Claims, 2 Drawing Sheets

CONDUCTING ELEMENT FOR SHUNTING AN ELECTRIC POWER SUPPLY

DESCRIPTION

The present invention relates to a conducting element for shunting an electric power supply from a main conductor to an accessory device operatively associated with a circuit breaker, particularly for low-voltage applications, i.e., with operating voltages up to approximately 1000 volts.

Generally, low-voltage industrial electrical systems involving high currents, and therefore high power levels, normally use specific devices commonly known in the art as automatic circuit breakers.

Said circuit breakers typically operate with AC currents, whose nominal value, depending on the applications, can vary over a wide range, typically from a few hundred to several thousand amperes, and are conceived so as to provide a performance that is essential in order to ensure the correct operation of the electrical system in which they are inserted and of the loads connected thereto.

In particular, said circuit breakers protect the loads from abnormal events caused for example by short-circuit faults or overloads by automatically opening the power supply circuit, allow the correct insertion/disconnection of loads in and from the circuit, ensure that the nominal current for the various connected users actually matches to the required current, and allow, by manual intervention on a lever for actuating said circuit breaker and for correspondingly separating the moving contacts from the fixed ones, the full isolation of a load with respect to a power source and the consequent disconnection of the circuit that they protect.

In many practical applications, for example when used in automated industrial electrical systems, the circuit breakers are assigned additional functions that are auxiliary with respect to the basic ones that they normally perform; said auxiliary functions can relate, for example, to the remote opening or closure of the electric circuit in which the circuit breaker is included, protection against drops in the supply voltage, and others.

When these auxiliary functions are required, the circuit breakers are equipped with appropriate accessory devices operatively associated therewith, such as for example undervoltage coils, shunt tripping coils, et cetera.

The operation of these accessories normally requires the use of a dedicated power supply, which can be obtained independently of the main circuit in which the circuit breaker is used or can be shunted directly from said circuit.

In the first case, additional components, such as for example transformers or batteries, are used, according to a solution that in any case is not ideal from the point of view of installation owing to costs and space occupation.

In the second case, instead, the electric power for supplying the accessory devices is drawn directly from the main conductors of the circuit upstream of the circuit breaker, using shunt conductors.

In the current state of the art, this method of supplying power to the accessory devices is achieved according to configurations that are not standardized and are provided by virtue of makeshift means that depend exclusively on the experience and skill of the installer. Moreover, these solutions are particularly labor-intensive, especially when they are provided after the installation of the circuit breaker, are expensive, and are potentially dangerous as regards the general safety conditions of the installer and of the system.

For example, one solution that is typically used in electrical panels entails providing holes in the distribution bars to which the main cables for connection to the circuit breaker are connected, and connecting shunt cables to said bars by virtue of appropriate terminals; the shunt cables are then wired to the accessory device. These operations are clearly disadvantageous owing both to their intrinsic laboriousness and to the use of labor that they entail; moreover, the presence of terminals and shunt cables, in addition to having an impact on costs, has a negative effect on safety conditions, especially if the distance between the phases of the main circuit is decreased. Finally, since the operations for shunting the power supply are entrusted to the manual intervention of the installers, the possibilities of errors also increase.

The aim of the present invention is to provide a conducting element for shunting an electric power supply from a main conductor to an accessory device operatively associated with a circuit breaker that allows to obviate the drawbacks of the known art and in particular to standardize the constructive configurations, facilitating the work of the operators and reducing their possibilities of error.

Within the scope of this aim, an object of the present invention is to provide a conducting element for shunting an electric power supply from a main conductor to an accessory device operatively associated with a circuit breaker that allows to supply the accessory device directly from the main circuit in which the circuit breaker is inserted, eliminating the use of terminals and shunt cables.

Another object of the present invention is to provide a conducting element for shunting an electric power supply from a main conductor to an accessory device operatively associated with a circuit breaker that allows to improve the general safety conditions both for installers and for the system.

Another object of the present invention is to provide a conducting element for shunting an electric power supply from a main conductor to an accessory device operatively associated with a circuit breaker that allows to simplify the work of an installer even when the circuit breaker has already been installed and allows to reduce intervention times, avoiding for example the provision of holes in the distribution bars and facilitating the wiring steps.

Another object of the present invention is to provide a conducting element for shunting an electric power supply from a main conductor to an accessory device operatively associated with a circuit breaker that is highly reliable, relatively easy to manufacture and at competitive costs.

This aim, these objects and others that will become apparent hereinafter are achieved by a conducting element for shunting an electric power supply from a main conductor to an accessory device operatively associated with a circuit breaker, characterized in that it comprises a contoured body that is meant to be arranged in a seat on the body of the circuit breaker in which a terminal for connection to said main conductor is arranged, said contoured body comprising at least one first surface that is suitable to be rested against a wall of said seat on the circuit breaker body and a second surface that protrudes at right angles from the first surface and is suitable to operatively couple to an additional conducting component that can be connected electrically to said accessory device.

The expression "main conductor" is to be understood as designating a conductor that is part of the power supply circuit in which the circuit breaker is included.

In this manner, by virtue of the conducting element according to the invention it is possible to shunt the power required for the operation of the accessory device directly from the conductor of the main power supply circuit in which the circuit breaker is used, without using additional terminals and shunt cables, and according to standardized constructive solutions that allow to simplify the work of the installers, reduce intervention times and increase safety conditions.

Further characteristics and advantages of the invention will become apparent from the description of some preferred but not exclusive embodiments of a conducting element according to the invention, illustrated only by way of non-limitative example with the aid of the accompanying drawings, wherein.

Figure 1:
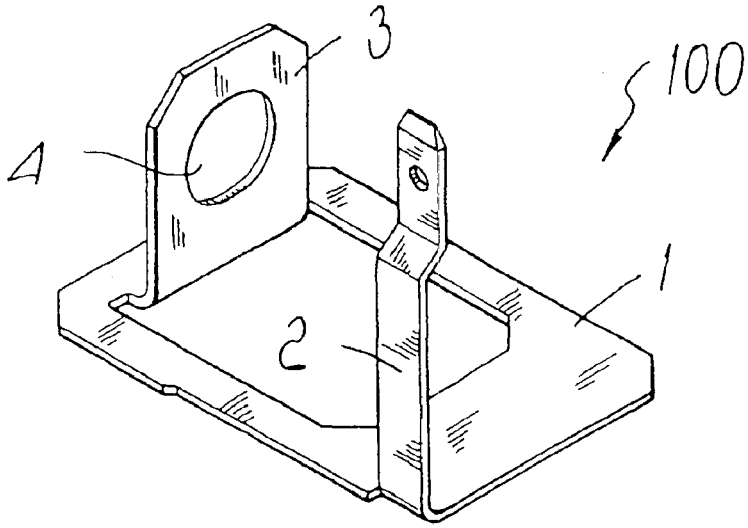
FIG. 1 is a perspective view of the conducting element according to the invention.

With reference to the above cited figures, the element according to the invention, generally designated by the reference numeral 100, comprises a contoured body made of electrically conducting material; said contoured body is meant to be arranged in a seat 5 on the body of an automatic circuit breaker 10 in which there is a terminal for connection to a main conductor (not shown), and is suitable to allow the shunting of electric power from said main conductor to an accessory device which is operatively associated with the circuit breaker, in the manner described in greater detail hereinafter.

Figure 2:
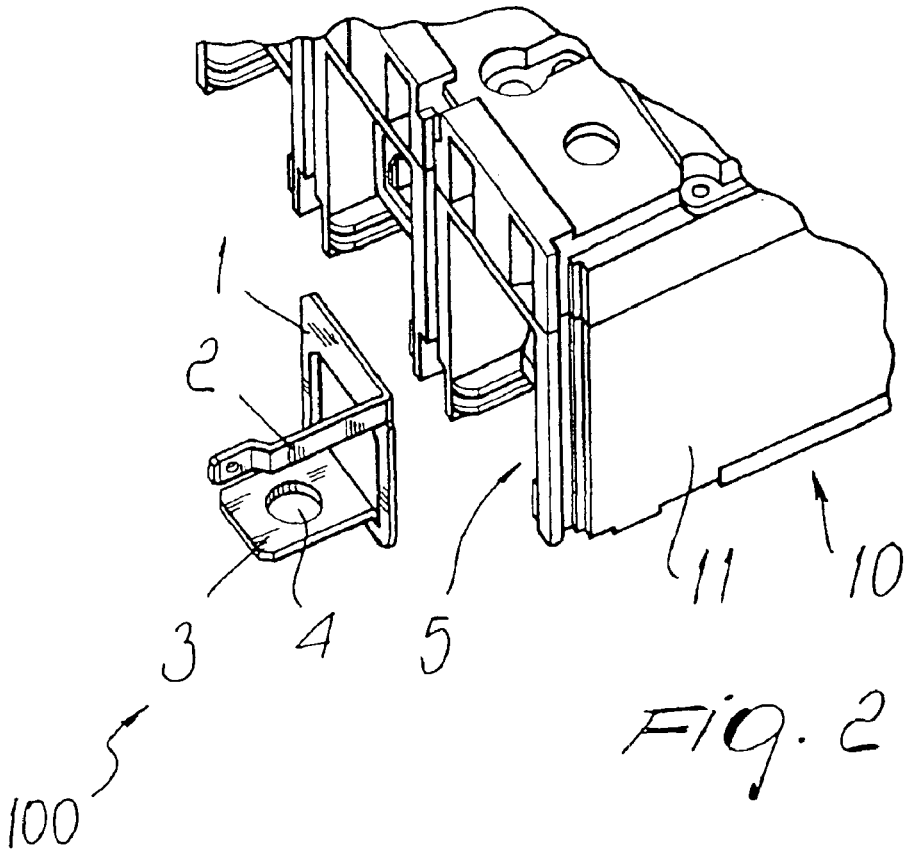
FIG. 2 is a perspective view showing the conducting element of FIG. 1 during installation on the body of a circuit breaker.
Figure 3:
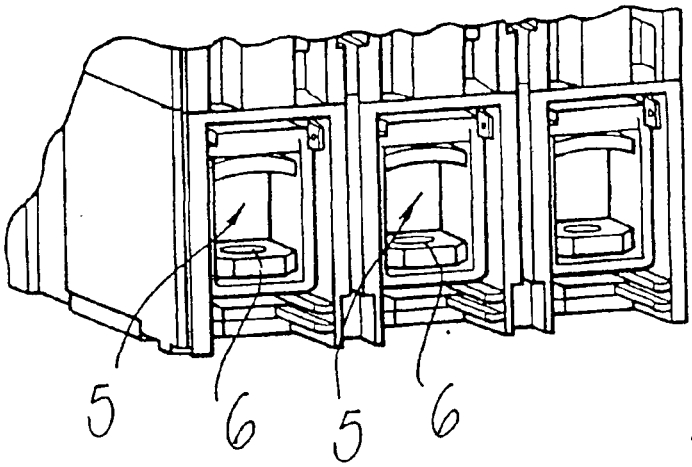
FIG. 3 is a perspective view of the conducting element of FIG. 1, inserted in a seat on the body of a circuit breaker.
Figure 4:
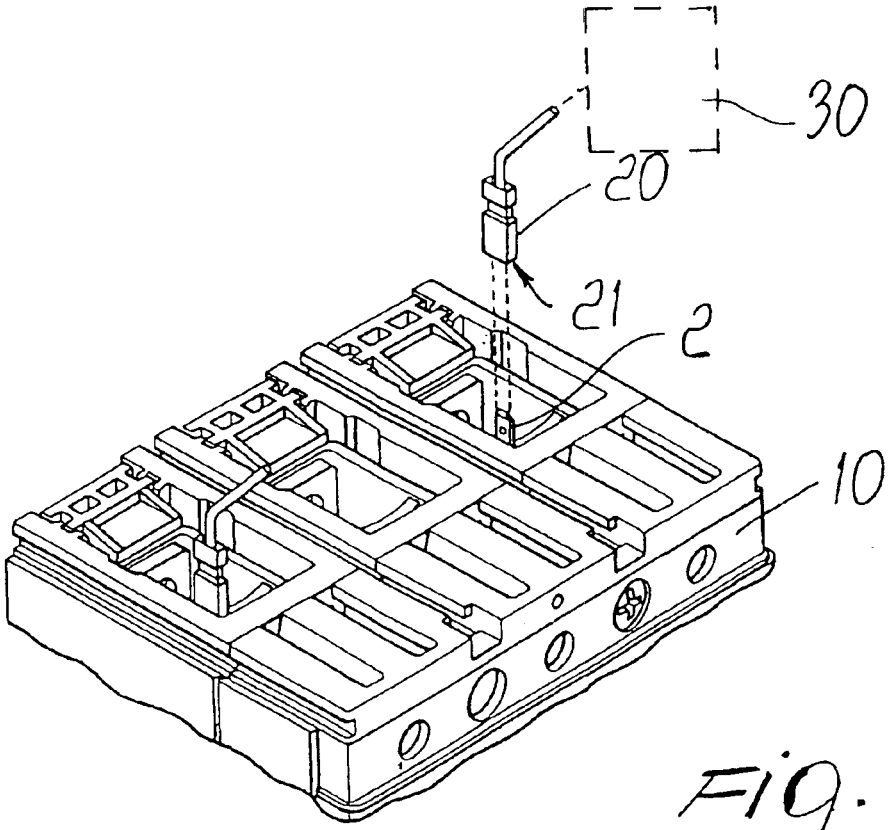
FIG. 4 is a perspective view of the element according to the invention during coupling to a unipolar plug socket.

FIGS. 2 to 4 are partial views of a low-voltage multipole automatic circuit breaker 10, which according to embodiments that are widely known in the art and therefore are not shown in detail comprises terminals for connection to the conductors of the electric circuit in which it is included, an enclosure 11 which, for each pole, contains at least one fixed contact and one moving contact, which can be operatively mutually coupled/uncoupled, and actuation means suitable to supply the energy required to move the moving contacts.

In turn, the accessory device, schematically represented in FIG. 4 by the outlined box 30, can be constituted for example by an undervoltage coil, or by a shunt tripping coil, or by a measuring unit; the embodiment of the various accessory devices used commonly in practice, as well as the practical methods of connection to the circuit breaker associated therewith, are widely known in the art and therefore are not described in detail.

As shown in detail in FIG. 1, the contoured body of the element 100 comprises at least one first flat surface 1, which for example has, seen in plan view, a substantially quadrilateral body with edges that are optionally chamfered, and a second surface 2, which protrudes at right angles from the first surface 1 proximate to an edge thereof and has a rod-like body that has an end suitable to be connected electrically to an additional conducting component.

Said conducting component, constituted for example by a unipolar socket plug, schematically designated by the reference numeral 20 in FIG. 4, is in turn connected electrically to the accessory device of the circuit breaker 10, in manners that are widely known in the art and are therefore not described here.

In a preferred embodiment, the element 100 comprises a third surface 3 that protrudes at right angles to the first surface 1 and has for example a substantially quadrilateral flat body with optionally chamfered edges that is suitable to make electrical contact with the corresponding terminal of the circuit breaker; a hole 4 is furthermore formed in the surface 3 and is suitable to accommodate means for fixing to the body of the circuit breaker 10.

As an alternative, one might provide the connection between the element 100 and the circuit breaker 10 by shaping the surface 1 differently, for example by providing it with appropriate protrusions that mate with corresponding seats formed in the body of the circuit breaker.

According to an embodiment that is advantageous from the point of view of production, the element 100 is formed monolithically so that the second surface 2 and the third surface 3 protrude from the surface 1 substantially at right angles thereto and in direction parallel to each other. Furthermore, as shown in the figures, the two surfaces 2 and 3 are arranged at two mutually opposite edges of the surface 1; as an alternative, their positioning, as well as their inclination with respect to the surface 1, might be varied appropriately according to the various requirements and/or needs of the application.

According to an embodiment that is particularly preferred and is even more advantageous from the point of view of production, the flat quadrilateral body of the third surface 3 is formed directly during production from the body of the surface 1, by virtue of a process that entails blanking the surface 1 along three mutually consecutive sides (with corresponding chamfered edges) that are internal to the edges of the body of said surface 1; the resulting part is then bent about the edge that has remained structurally monolithic with the surface 1 until the resulting surface 3 is arranged at substantially right angles to the surface 1. In this manner, starting from a single base element, one obtains two active surfaces that perform different functions. Furthermore, the rod-like body of the surface 2 is also obtained by bending with respect to the surface 1.

As an alternative, the body of the element 100 might be provided in two or more parts, for example by separately manufacturing the body that constitutes the surface 3 and then connecting it to the remaining parts, for example by welding.

The practical use of the element 100 is now described with particular reference to FIGS. 2 to 4.

As shown in said figures, the element 100 is inserted in a seat 5 formed in the body of the circuit breaker 10, so that the surface 1 rests against a wall of the seat 5; one then fixes the surface 3 with the body of the circuit breaker 10, by virtue of fixing means, typically a screw, inserted in the hole 4 and screwed to a wall 6 of said circuit breaker. Once the wiring of the main conductor to the connection terminal has been completed, the surface 3 of the element 100 is electrically in contact with a surface of the connecting terminal and therefore with said main conductor. Clearly, as shown in FIG. 3, for each pole of the circuit breaker 10 it is possible to use an element 100 that is inserted in a corresponding seat 5. In this manner, the assembly constituted by the circuit breaker 10 and the elements 100 constitutes a block that can be used in practice as a single independent component. Accordingly, the present invention also relates to a multipole low-voltage circuit breaker comprising terminals for connection to an electric power supply circuit, an enclosure that contains, for each pole, at least one fixed contact and a moving contact that can be mutually operatively connected/disconnected, actuation means suitable to supply the energy required to move the moving contacts, characterized in that it comprises at least one conducting element 100 of the type described above.

In turn, as shown in FIG. 4, the element 100 is then connected to a conducting component, in the specific case a unipolar plug socket 20, which is electrically connected to the accessory device associated with the circuit breaker 10. In particular, according to a solution that is effective from the functional point of view and simple from the constructive point of view, the coupling between the element 100 and the socket 20 is of the male-female type by virtue of the insertion of the end of the rod-like body of the surface 2 in a seat 21 of the socket. In this manner, one obtains a power supply shunting device that is functionally effective, simple and quick to provide, and according to a configuration which is at once uncluttered and safe.

Accordingly, another aspect of the present invention relates to a device for shunting power from a main conductor to an accessory device operatively associated with a circuit breaker, characterized in that it comprises a first conducting component, for example a unipolar plug socket, which can be connected electrically to said accessory device, and a second conducting element 100 of the type described above.

It should also be noted that once the various components have been installed and the electrical connections among the various parts have been provided, one obtains as a whole a device for protecting and interrupting an electric power supply circuit that is highly effective, safe and reliable in performing both the basic functions normally required of the circuit breaker alone and the auxiliary ones that depend on the type of accessory to be used, the supply of power to the accessory device being obtained directly from the power supply circuit, thus eliminating the technical drawbacks and the constructive difficulties of the known art.

Accordingly, another aspect of the present invention relates to a device for protecting and interrupting an electric power supply circuit, characterized in that it comprises:

- a low-voltage multipole circuit breaker;
- an accessory device operatively associated with said circuit breaker;
- a device for shunting power from a main conductor of the circuit as described above.

In practice it has been found that the conducting element according to the invention fully achieves the intended aim and objects, allowing to obviate the drawbacks of the prior art and providing a significant series of advantages.

The element 100, by virtue of its constructive structure, in addition to being easy to manufacture and economically advantageous, in fact allows to simplify the operations required to shunt the power supply for an accessory device, thus reducing production costs and times, even when the circuit breaker has already been installed; furthermore, it allows to eliminate the use of additional shunting terminals and cables and to have standardized configuration solutions that are independent of the skill and experience of the installers, and are uncluttered and safe both for operators and for the system itself.

The element thus conceived is susceptible of modifications and variations, all of which are within the scope of the inventive concept; all the details may furthermore be replaced with technically equivalent elements. In practice, the materials used, so long as they are compatible with the specific use, as well as the dimensions, may be any according to the requirements and the state of the art.

What is claimed is:

1. A conducting element for shunting an electric power supply from a main conductor to an accessory device operatively associated with a circuit breaker, characterized in that it comprises a contoured body arranged in a seat on the body of the circuit breaker in which a terminal for connection to said main conductor is arranged, said contoured body further comprising at least one first surface that is rested against a wall of said seat on the circuit breaker body and a second surface that protrudes at right angles from the first surface and is operatively coupled to an additional conducting component connected electrically to said accessory device.

2. The conducting element according to claim 1, characterized in that it comprises a third surface that protrudes at right angles from the first surface, structurally connected to the circuit breaker body, and makes electrical contact with said terminal.

3. The conducting element, according to claim 1, characterized in that said second surface has a rod-like configuration, with an end connected electrically to said additional conducting component.

4. The conducting element according to claim 3, characterized in that said end of said rod-like element is shaped so as to allow a male-female coupling with said additional conducting component.

5. The conducting element according to claim 2, characterized in that said third surface has a substantially quadrilateral flat body in which there is a hole that accommodates means for fixing to a wall of the circuit breaker body.

6. The conducting element according to claim 1, characterized in that said contoured body is formed monolithically.

7. The conducting element according to claim 5, characterized in that said substantially quadrilateral flat body is obtained directly from said first surface by a blanking and bending process.

8. A multipole low-voltage circuit breaker characterized in that is comprises at least one conducting element according to claim 1.

9. A device for shunting power from a main conductor to an accessory device operatively associated with a circuit breaker, characterized in that it comprises:

- a first conducting component that can be electrically connected to said accessory device; and
- a second conducting element according to claim 1.

10. A device for protecting and interrupting an electric power supply circuit, characterized in that it comprises:

- a low-voltage multipole circuit breaker;
- an accessory device operatively associated with said circuit breaker; and
- a device for shunting power from a main conductor of the circuit according to claim 9.

11. The conducting element according to claim 2, characterized in that said contoured body is formed monolithically.

12. The conducting element according to claim 3, characterized in that said contoured body is formed monolithically.

13. The conducting element according to claim 4, characterized in that said contoured body is formed monolithically.

14. The conducting element according to claim 5, characterized in that said contoured body is formed monolithically.

15. A multipole low-voltage circuit breaker characterized in that is comprises at least one conducting element according to claim 2.

16. A multiple low-voltage circuit breaker characterized in that is comprises at least one conducting element according to claim 3.

17. A multipole low-voltage circuit breaker characterized in that is comprises at least one conducting element according to claim 4.

18. A multipole low-voltage circuit breaker characterized in that is comprises at least one conducting element according to claim 5.

19. A multipole low-voltage circuit breaker characterized in that is comprises at least one conducting element according to claim 6.

20. A multipole low-voltage circuit breaker characterized in that is comprises at least one conducting element according to claim 7.

* * * * *